United States Patent [19]

Narutani et al.

[11] Patent Number: 4,690,798

[45] Date of Patent: Sep. 1, 1987

[54] ULTRASOFT STAINLESS STEEL

[75] Inventors: Tetsu Narutani; Shigeharu Suzuki, both of Chiba, Japan

[73] Assignee: Kawasaki Steel Corporation, Hyogo, Japan

[21] Appl. No.: 830,696

[22] Filed: Feb. 18, 1986

[30] Foreign Application Priority Data

Feb. 19, 1985 [JP] Japan ..... 60-31020
Apr. 12, 1985 [JP] Japan ..... 60-77876

[51] Int. Cl.[4] ..... C22C 38/20
[52] U.S. Cl. ..... 420/61; 420/63
[58] Field of Search ..... 75/124 R, 124 F, 124 E, 75/125, 128 N, 126 J, 128 G, 128 T, 128 V; 420/34, 61, 62, 63

[56] References Cited

U.S. PATENT DOCUMENTS 3,607,237 9/1971 Kalita ..... 75/124
3,607,246 9/1971 Kalita ..... 75/124
4,331,474 5/1982 Espy ..... 75/128 G
4,465,525 8/1984 Yoshimura et al. ..... 75/124

FOREIGN PATENT DOCUMENTS 49-15696 4/1974 Japan .
52-66816 6/1977 Japan .
55-89431 7/1980 Japan .
58-56012 12/1983 Japan .

OTHER PUBLICATIONS

Chromium-Vandium Rail Steels Chromium Review No. 1, Apr. 1983.

*Primary Examiner*—L. Dewayne Rutledge
*Assistant Examiner*—Deborah Yee
*Attorney, Agent, or Firm*—Austin R. Miller

[57] ABSTRACT

An ultrasoft ferritic stainless steel having excellent stamping formability and corrosion resistance in use, which consists essentially of:

about 0.002 to 0.03% by weight of carbon, about 0.01 to 0.30% by weight of silicon, about 0.01 to 1.5% by weight of manganese, about 0.003 to 0.04% by weight of phosphorus, about 0.001 to 0.15% by weight of sulfur, about 0.02 to 1.0% by weight of nickel, about 0.005 to 0.50% by weight of copper, about 0.01 to 0.6% by weight of molybdenum, about 11.5% to 20% by weight of chromium, about 0.005 to 0.03% by weight of nitrogen, about 0.005% to 0.20% by weight of aluminum, and the balance consisting of iron and conventional impurities, said ultrasoft steel having a Vickers hardness equal to about 140 or less.

16 Claims, 5 Drawing Figures

ULTRASOFT STAINLESS STEEL

This invention relates to ultrasoft ferritic stainless steel, and more particularly relates to an extremely soft ferritic stainless steel having optimum properties for making stamped products such as coins, medals, keys and the like, which are produced by precise stamping in a cold press, for example.

DESCRIPTION OF THE PRIOR ART

According to *Chromium Review*, No. 1, Apr. 1983, various types of stainless steels have been used for making more than 5.5% of the total coins newly issued in 1979 among 117 countries in the world. This means that stainless steels have been considered advantageous from a viewpoint of both production economy and coin durability in use. Stainless steel coins have attractive luster and good corrosion and abrasion resistance. They also have economical advantages over other materials such as copper alloys, etc.

However, a major problem where stainless steel is used in coins is its hardness. This causes serious problems in coin production, that is, a large capacity pressing machine is necessary for effective stamping. Also, the life of the die for coining is short, because of the hardness of stainless steel and the high coining pressures that are needed.

Laid open Japanese Pat. No. 55-89431 discloses the use of stainless steel for coins. The steel is a ferritic stainless steel comprising 12 to 18% by weight of chromium, with other additive elements reduced or eliminated as far as possible. Further, in preparing the steel the hot roll finishing temperature should be kept at or less than 800° C. in order to obtain good ridging properties in the steel. Moreover, the coiling temperature should be kept at or below 450° C.

However, there are many problems in attempting to reduce the content of elements other than chromium. For example, reducing the content of carbon or nitrogen causes an increase of the cost of production of the stainless steel. Limiting silicon to a low level causes insufficient deoxidation to take place, and results in a deteriorated surface condition which is harmful for the production of coins.

It is known that lowering the coiling temperature is effective to improve the ridging tendency of the steel, as disclosed in Japanese published Pat. No. 49-15696, Japanese laid open Pat. No. 52-66816, Japanese published Pat. No. 58-56012, etc. But reducing the coiling temperature to a value of 450° C. or below causes the hot rolled coils to have extremely bad shapes. This would be expected to become a critical disadvantage in the use of stainless steel for coins. Therefore it will be understood that an important advantage would be gained by decreasing the hardness of ferritic stainless steel, and that it would be very significant to utilize stainless steel because of its intrinsic advantage as a material for coins.

OBJECTS OF THE INVENTION

An important object of the present invention is to provide a stainless steel product which has excellent cold pressing properties and outstanding corrosion and abrasion resistance after extended use, and other beneficial properties for use as coins, keys and other pressed or stamped objects.

A further object is to supply an ultrasoft ferritic stainless steel having a hardness equal to or less than 140 on the Vickers scale, and to overcome the problems associated with high hardness which has been a major problem in the prior art.

Other objects and advantages of this invention, including production economy and ready adaptability for use in existing production processes and equipment, will appear in further detail hereinafter, and in the drawings.

DRAWINGS

SUMMARY OF THE INVENTION

Figure 1:
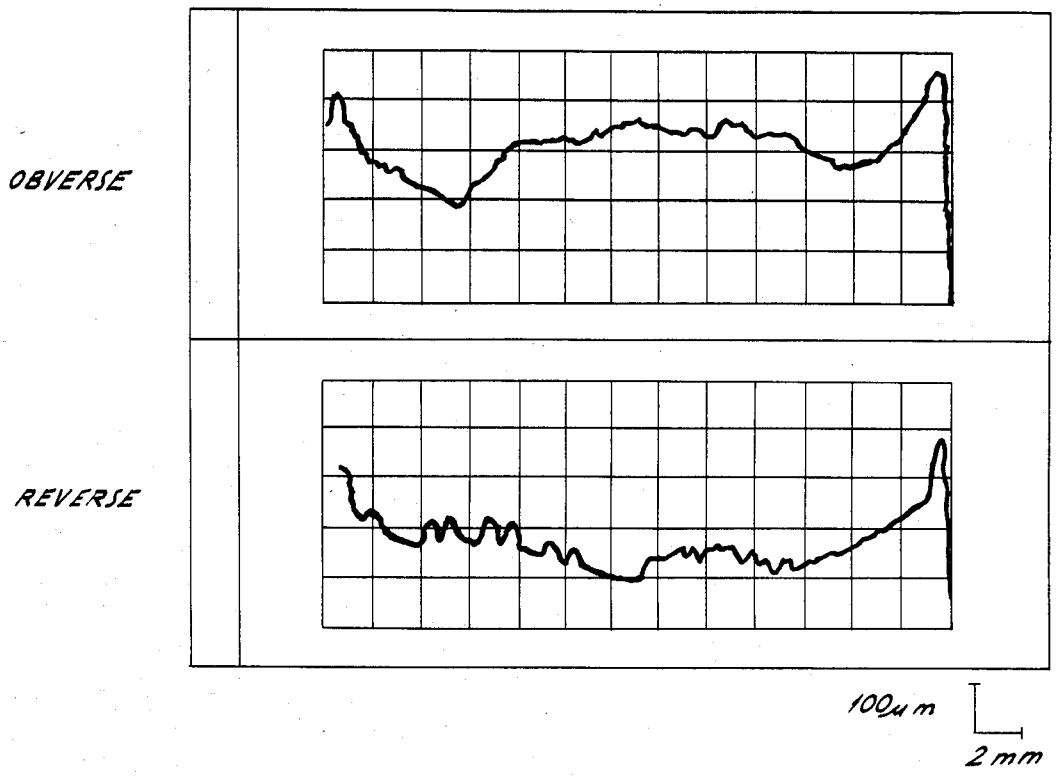
FIG. 1 shows charts obtained by plotting the surface configurations of the obverse and reverse of an Italian 100 lira coin made of conventional ferritic stainless steel.

It has been discovered that the foregoing objects are accomplished by providing an ultrasoft ferritic stainless steel having excellent coining formability which has a composition consisting essentially by weight of about:

C: 0.002 to 0.03%
Si: 0.01 to 0.30%
Mn: 0.01 to 1.5%
P : 0.003 to 0.04%
S : 0.001 to 0.15%
Ni: 0.02 to 1.0%
Cu: 0.005 to 0.5%
Mo: 0.01 to 0.6%
Cr: 11.5% to 20%
N : 0.005 to 0.03% and adding to the above composition an alloy component consisting of one or more members, in the indicated quantities by weight, selected from the group consisting of Al: 0.005% to 0.20%, Ti : 0.005% to 0.2%, Nb : 0.005% to 0.2% and V : 0.005% to 0.2% and essentially the balance Fe, and which has a Vickers hardness equal to or less than about 140.

We have conducted a correlation analysis among components of 87 different embodiments of ferritic stainless steels containing various quantities of ten frequently occurring elements, including C, Si, Mn, P, S, Cr, Ni, Cu, Mo and N. We determined the Vickers hardness of those steels, in each of which the grain size was controlled substantially to a constant value of 20 micro meters to 30 micro meters. As a result we have discovered the relationship $$Hv = 73.3 - 12.3\,(\%\,C) + 22.7\,(\%\,Si) + 0.8\,(\%\,Mn) + 361\,(\%\,P) - 55.1\,(\%\,S) + 2.9\,(\%\,Cr) + 2.8\,(\%\,Ni) + 9.8\,(\%\,Cu) + 5.1\,(\%\,Mo) + 370\,(\%\,N). \quad (1)$$

Considering the level of constituent elements in ferritic stainless steels and the values of coefficients in the above formula, we have determined that five elements Si, P, Cu, Mo, N are particularly important elements of ferritic stainless steels and should especially carefully be controlled.

We have surprisingly found that although carbon is generally an element which increases hardness of steel, when used in the combination of this invention and combined as in formula (1) it instead has a negative correlation coefficient.

It has been found that carbon serves to precipitate chromium carbides such as $Cr_{23}C_6$ in ferritic stainless steel after the usual treatment. Therefore, carbon, in this case, does not exhibit its usual hardening effect by way of an intrinsic solid solution phenomenon, but does contribute to reduction of hardness by substantially decreasing the content of chromium having a solid solute hardening effect in ferritic stainless steel.

It has been found that a very soft ferritic stainless steel can be produced at low cost and on an industrial scale by restricting the range of the components as in the formula above mentioned, and that this can be done with economy in the steel making process, and providing a product with cleanliness and excellent surface characteristics.

It has accordingly been discovered that, in the composition of this invention, instead of having a hardening effect carbon has a softening effect as a result of chromium carbide formation. It had heretofore been considered, and in effect accepted, that addition of carbon would increase the hardness of the ferritic stainless steel product.

It has now been found that, from the viewpoint of hardness, it is not necessary to restrict severely the range of carbon content of the stainless steel.

However, on the other hand, materials for coins are required to have good corrosion resistance during the expected lifetimes of the coins, which are about fifteen to twenty years. It is thought that perspiration has the strongest corrosive effect on coins in actual usage.

Referring to the drawings, FIG. 1 shows the surface configurations of an Italian coin, representing its stamped condition on the obverse and reverse.

Figure 2:
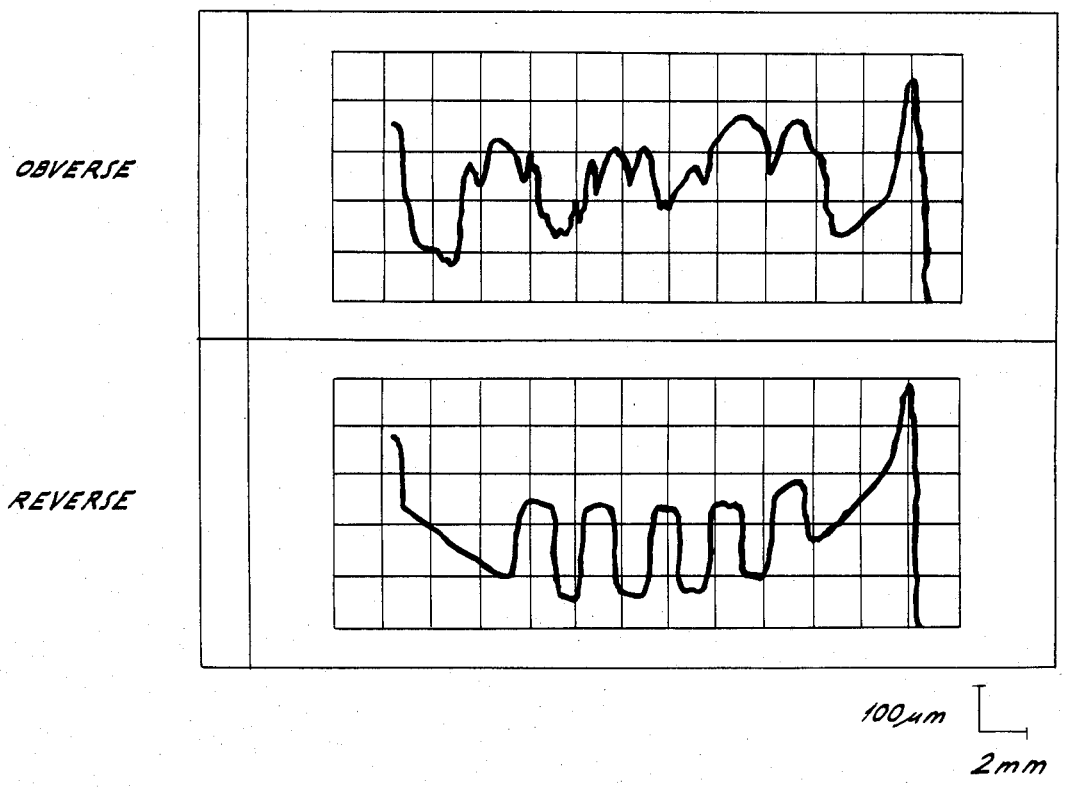
FIG. 2 shows charts obtained by similarly plotting the configurations of the obverse and reverse of a Japanese 100 yen coin made of cupronickel comprising 75% Cu-25% Ni.

FIG. 2 shows the surface configurations of a Japanese 100 Yen coin made of cupronickel consisting of 75% Cu and 25% Ni, also showing the obverse and reverse.

Figure 3:
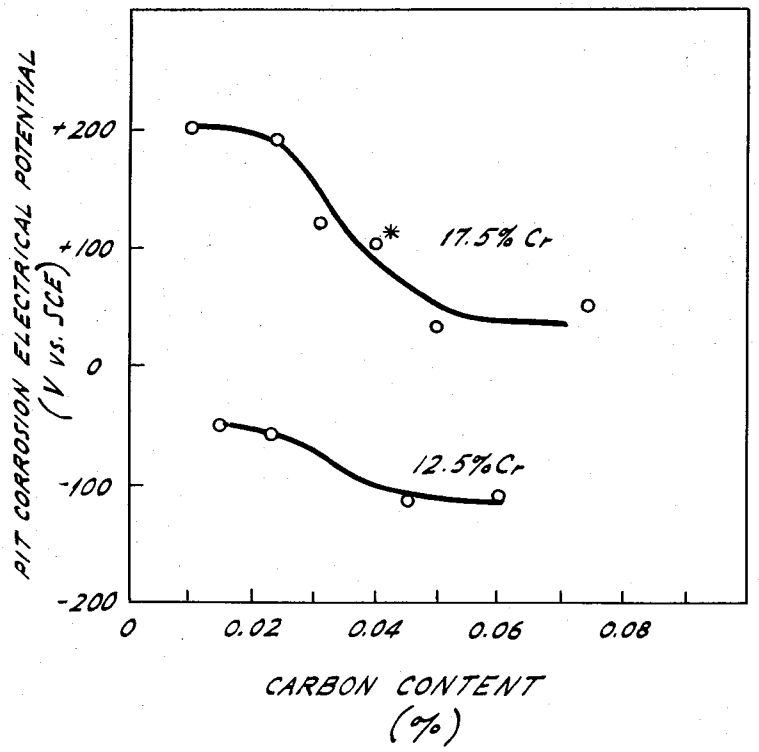
FIG. 3 shows the relationship in an Italian stainless steel coin between pit corrosion electrical potential in artificially-made perspiration solution and the amount of carbon for ferritic stainless steel.

FIG. 3 of the drawings shows the results of tests involving measuring the pitting corrosion potential of stainless steel test pieces immersed in artificially-made perspiration solution. Stainless steels comprising Si/0.10%, Mn/0.50%, P/0.001%, Cr/12.5% and 17.5%, Al/0.05% and carbon in a range from 0.010–0.074% were melted and annealed cold rolled sheets of the stainless steels were made into test pieces. The results obtained from stainless steel for current Italian coins are comparatively shown.

The measurements were made as follows. Anodic polarization tests were conducted in an artificially-made perspiration solution of NaCl 7 grams, urea 1 gram, lactic acid 4 grams and water 1 liter, by using an SCE (saturated calomel electrode) as a standard electrode.

Figure 4:
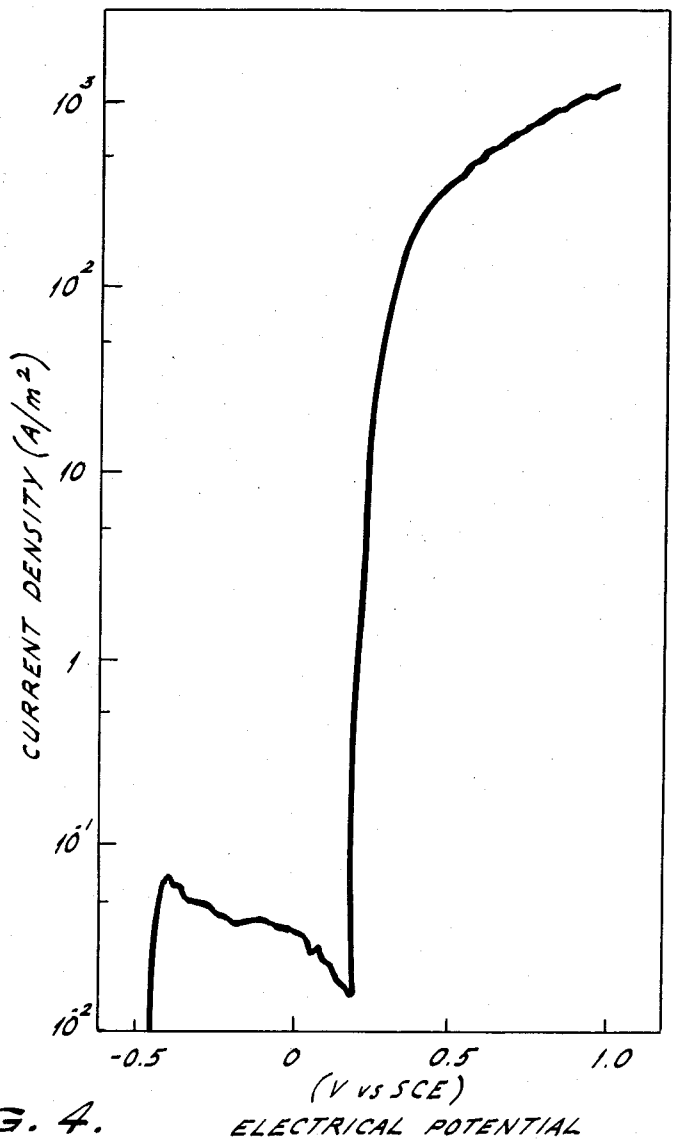
FIG. 4 shows an anodic polarization curve of the specimen of Example E of the present invention, tested in an artificially-made perspiration solution.
Figure 5:
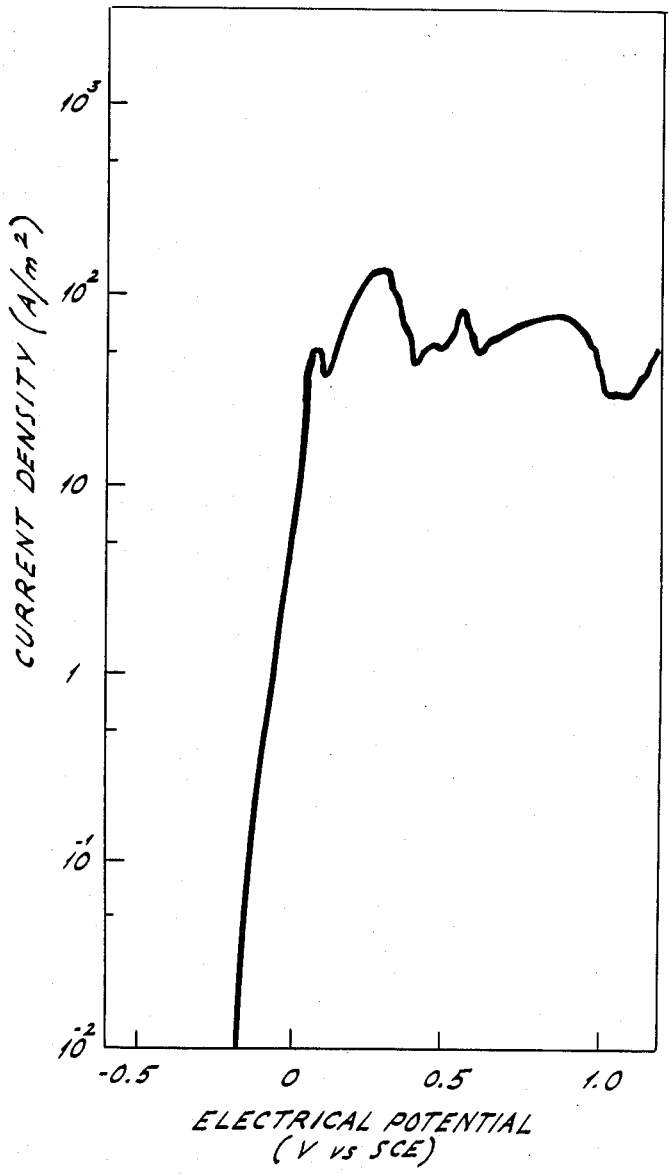
FIG. 5 shows an anodic polarization curve of cupronickel as a comparative example in an artificially-made perspiration solution using the same procedure as in FIG. 4.

Each specimen was immersed in artificially-made perspiration solution at 35° C., −500 mv was applied by the SCE for ten minutes, and the sample was kept immersed further for 10 minutes at the natural immersion potential. It was then swept with an increasing voltage at a rate of 20 mv per minute, until a voltage of 1 volt was reached. On the charts of the anodic polarization curves thus obtained, FIGS. 4 and 5, the pitting corrosion potential is defined as the potential corresponding to a dissolving current density reaching a value of 100 micro A/cm$^2$, when the rapid dissolution begins with the initiation of pit corrosion. From the drawings it can be understood that the pitting corrosion potential in the artificially-made perspiration solution was strongly affected by the content of carbon in the steel, regardless of the chromium content. The carbon content of the present invention should be restricted to less than about 0.03% by weight accordingly.

By this restriction of carbon content, superior corrosion resistance is obtained, compared to that of commercial stainless steel used for current Italian coins, at a chromium level of about 17.5% by weight.

Proportions of the Ingredients

Silicon is considered a necessary element for deoxidation in the steel making process, but it has a strong tendency to increase hardness. In accordance with the present invention deoxidation is actively carried out by the presence of aluminum. The upper range of the silicon content is limited to about 0.3% by weight when the minimum amount of silicon is used.

As is clear from the above formula (1), manganese has such a small effect on hardness that the increase of hardness on the Vickers scale is less than one for a manganese addition of 1% by weight. But when the manganese content exceeds about 1.5%, corrosion resistance becomes a factor. Thus the upper limit of the manganese content should be about 1.5% by weight.

Phosphorus has, as shown in the above formula (1), such a high correlating coefficient (361) that the phosphorus content should be limited as far as possible. In keeping with considerations of economy for dephosphorization in the steel making process, the phosphorus content should be about 0.04% or less.

Sulfur has been found to have a negative coefficient in the above formula (1). It has found to be desirable to add sulfur to a rather high content. However, a sulfur content exceeding about 0.15% by weight causes deterioration of corrosion resistance. Therefore, the upper limit of the sulfur content should be about 0.15% by weight.

In regard to Ni, Cu and Mo, in considering that the Hv increasing coefficients of Ni, Cu and Mo in the above formula (1) are 2.6, 9.8 and 5.1 respectively, and with the objective of limiting the total increase of Hv hardness within about 3 by these three elements as an upper limit, the contents of Ni, Cu and Mo should be about 1.0%, 0.50% and 0.60% by weight or less, respectively.

Chromium is a very important element in relation to corrosion resistance of ferritic stainless steel. A chromium content less than about 11.5% by weight scarcely contributes enough corrosion resistance, while a Cr content exceeding about 20% by weight decreases hot formability. Therefore the chromium content should be limited within the range of about 11.5% to about 20% by weight.

Nitrogen has a large effect on increasing the Hv coefficient, and nitrogen content should be kept low. As nitrogen is stabilized as AlN, TiN, NbN or VN by adding a corresponding amount of Al, Ti, Nb or V in the present invention, the upper limit of nitrogen is determined to be about 0.03% by weight. Reduction of nitrogen percentage to a very low content, by use of known processes, is complicated and expensive. In this invention reduction of nitrogen content is not necessary because the existing nitrogen is stabilized as AlN, TiN, NbN or VN instead. The content of nitrogen should be less than about 0.03% by weight.

Addition of a controlled amount of nitride forming elements, Al, Ti, Nb and V, is one of the most remarkable features of the present invention. The effect of these elements in the present invention in stabilizing nitrogen affects the Hv hardness most advantageously with the formation of AlN, TiN, NbN and VN, the solid solution hardening effect of nitrogen is effectively overcome and the nitrogen bound to these elements contributes essentially no undesirable hardening effect.

The correlation coefficient of aluminum for Hv hardness is obtained for a series of ferritic stainless steels comprising about 0.5% to 3% by weight of aluminum, by the same method as obtained by the above formula (1). It has been found that this coefficient is 6.1 and that aluminum has a hardening effect. On the other hand, in case of addition of aluminum at about 0.20% by weight or less, the solid solution hardening effect can be suppressed by addition of aluminum in an amount equal to or less than three times the atomic percentage of nitrogen, the solid solute nitrogen being stabilized as AlN.

On the other hand, as the Hv hardening coefficient of solid solute aluminum has been discovered to be +6.1, excessive addition of aluminum causes an increase of Hv hardness. Therefore, the upper limit of aluminum content has been determined to be about 0.20% by weight, and the lower limit about 0.005% by weight, all in relation to deoxidation and restriction of the nitrogen content to 0.03% by weight or less. Thus the range of aluminum content in accordance with this invention has been determined to be 0.005% to 0.20% by weight.

Regarding Ti, Nb and V, important effects of Ti, Nb and V in the present invention also involve the stabilization of nitrogen which has a strong effect on Hv hardness as described above. Nitrogen combines as TiN, NbN and VN respectively, owing to strong tendency toward nitride formation. This overcomes the solid solute hardening effect of nitrogen.

Some of the ferritic stainless steels comprise about 0.20% to 0.60% by weight of Ti, Nb and V respectively, with the further advantage of improving corrosion resistance. For ferritic stainless steels comprising Ti, Nb and V in amounts within the above mentioned range, the Hv hardness coefficients of Ti, Nb and V have been discovered to be +11.2, +17.2 and +7.4 respectively. This shows that those elements have strong hardening effects.

On the other hand, in case of addition of Ti, Nb or V in a total amount of 0.2% in weight or less, the solid solution hardening effect can be suppressed by controlling the addition of Ti, Nb or V to an amount equal to or less than about three times the content of nitrogen in atomic percent. In this case the nitrogen is substantially stabilized as nitride, and the solid solute Ti, Nb and V each of which has a substantial hardening effect, can be kept at a low enough level to be neglected.

Another problem confronting the steelmaker is that Ti addition causes nozzle cloggings of the tundish or immersion pipes, and also increases the frequency of occurrence of surface defects. This problem may be overcome in accordance with this invention, when the N content is limited to less than about 0.03% by weight, and by adding Ti in an amount of about 0.20% or less. The upper limit of titanium content is accordingly about 0.2% by weight. This effect is correspondingly realized even when there is even less addition of Ti, Nb or V. However, it is necessary to provide at least about 0.005% by weight of each of these elements, to achieve a substantial effect. Therefore, in accordance with this invention, the amount of addition of each of Ti, V or Nb should be limited to the range of about 0.005% to 0.20% by weight.

In regard to the Hardness Index HvN, the present invention has remarkable features in introducing the value of the Hardness Index as shown below. There is an important relationship between hardness and content of the main elements of the ferritic stainless steel, as quantitatively expressed by the formula (1). The present invention makes it possible to stabilize nitrogen having a strong solid solution hardening effect and concurrently to stabilize nitrogen having a strong solid solution hardening effect by addition of at least of proper amount of Al, Ti, Nb and V, while keeping the levels of Al, Ti, Nb and V low enough for the solid solution hardening effect of those elements per se to be essentially negligible.

Thus it has been found that the substantial relationship between hardness and components can be estimated by the Hardness Index (HvN) where the term of N in the formula (1) and the hardening effect of Al, Ti, Nb and V are neglected, the formula being as follows:

$$\begin{aligned} HvN = 73.3 - 12.3\,(\%\,Cr) + 22.7\,(\%\,Si) + 0.8\,(\%\,Mn) + \\ 361\,(\%\,P) - 55.1\,(\%\,S) + 2.9\,(\%\,Cr) + 2.6\,(\%\,Ni) + \\ 9.8\,(\%\,Cu) + 5.1\,(\%\,Mo) \end{aligned} \quad (2)$$

In accordance with the present invention the Hardness Index is preferably restricted to about 140 or less. In addition to the advantages already expressed, the press power for performing coining or pressing operations is remarkably reduced as compared to the power used when working with existing and conventional stainless steels.

The ferritic stainless steel in accordance with this invention, containing residual iron and unavoidable impurities, easily attains a Vickers hardness of 140 in its final form as an annealed cold rolled sheet. Thus the ferritic stainless steel is remarkably softer than existing stainless steels.

In the present invention, the annealing conditions to and through final annealing are not specifically restricted. However, especially in case of material wherein only Al is added, the annealing temperature after final cold rolling is preferably about 900° C. or less. Higher annealing temperatures of about 900° C. or above tend to cause the phenomenon of AlN backing to solid solute, resulting in increase of content of solid solute N, which increases the hardness of the steel.

EXAMPLES

The following examples have been selected as being illustrative of the practice of this invention. They are not intended to define or to limit the scope of the invention, which is defined in the appended claims. These examples were conducted with the use of formulas as shown. Comparative examples are provided to show prior art compositions. The comparative examples are ordinally SUS 430 and a stainless steel with some composition as ferritic stainless steel used for Italian coins.

Reference is also made to Table 1 which sets forth the indicated characteristics of specimens A–X produced according to this invention, and compares them with characteristics of other products not in accordance with this invention. It is to be noted, for example, that ferritic stainless steels 1 and 2 which have Ti or Nb contents of 0.36% or 0.50% respectively, exceed the limits of the present invention though having low carbon content and low nitrogen content.

TABLE 1

| SPECIMEN | CHEMICAL COMPONENT (% by weight) | | | | | | | | | | | | MECHANICAL PROPERTIES | | | | |
|---|---|---|---|---|---|---|---|---|---|---|---|---|---|---|---|---|---|
| | C | Si | Mn | P | S | Ni | Cu | Mo | Cr | N | Al | Others | HARDNESS INDEX HvN | HARDNESS (Hv) | YIELD STRESS (Kg/mm$^2$) | BREAKING STRESS (Kg/mm$^2$) | ELONGATION (%) |
| ULTRASOFT STAINLESS STEEL | | | | | | | | | | | | | | | | | |
| A | 0.006 | 0.21 | 1.31 | 0.019 | 0.001 | 0.03 | 0.08 | 0.01 | 12.4 | 0.0029 | 0.005 | — | 123 | 116 | 23.5 | 34.1 | 41.9 |
| B | 0.015 | 0.012 | 0.011 | 0.003 | 0.001 | 0.08 | 0.005 | 0.04 | 12.6 | 0.0024 | 0.010 | — | 111 | 103 | 21.6 | 31.6 | 47.0 |
| C | 0.019 | 0.09 | 0.21 | 0.017 | 0.12 | 0.21 | 0.03 | 0.02 | 15.1 | 0.018 | 0.15 | — | 120 | 115 | 24.4 | 35.2 | 41.3 |
| D | 0.027 | 0.10 | 0.32 | 0.012 | 0.002 | 0.10 | 0.016 | 0.06 | 16.3 | 0.028 | 0.068 | — | 128 | 121 | 23.4 | 37.6 | 41.8 |
| E | 0.015 | 0.22 | 0.61 | 0.030 | 0.008 | 0.14 | 0.03 | 0.17 | 16.2 | 0.021 | 0.085 | — | 137 | 135 | 31.2 | 40.3 | 35.9 |
| F | 0.024 | 0.11 | 0.50 | 0.022 | 0.001 | 0.04 | 0.02 | 0.01 | 17.5 | 0.015 | 0.051 | — | 135 | 130 | 30.3 | 40.0 | 35.7 |
| G | 0.002 | 0.067 | 0.96 | 0.022 | 0.001 | 0.04 | 0.02 | 0.01 | 17.6 | 0.025 | 0.007 | — | 135 | 133 | 30.8 | 39.3 | 38.6 |
| H | 0.003 | 0.023 | 0.011 | 0.003 | 0.001 | 0.02 | 0.01 | 0.03 | 17.8 | 0.0046 | 0.011 | — | 128 | 125 | 27.3 | 36.0 | 41.4 |
| I | 0.003 | 0.012 | 0.37 | 0.010 | 0.002 | 0.15 | 0.02 | 0.03 | 19.6 | 0.002 | 0.007 | — | 138 | 136 | 29.9 | 37.4 | 39.2 |
| J | 0.023 | 0.09 | 1.22 | 0.022 | 0.002 | 0.04 | 0.02 | 0.02 | 11.6 | 0.009 | 0.007 | Ti/0.03 | 118 | 113 | 22.9 | 33.1 | 44.2 |
| K | 0.017 | 0.24 | 0.54 | 0.012 | 0.003 | 0.08 | 0.04 | 0.02 | 14.7 | 0.026 | 0.008 | Ti/0.17 | 126 | 125 | 26.8 | 36.7 | 40.5 |
| L | 0.011 | 0.15 | 0.34 | 0.018 | 0.003 | 0.03 | 0.02 | 0.05 | 17.5 | 0.013 | 0.010 | Ti/0.05 | 134 | 129 | 28.8 | 38.3 | 37.5 |
| M | 0.004 | 0.014 | 0.45 | 0.006 | 0.001 | 0.03 | 0.01 | 0.04 | 19.2 | 0.005 | 0.005 | Ti/0.01 | 132 | 135 | 30.4 | 40.2 | 34.8 |
| N | 0.028 | 0.16 | 0.58 | 0.017 | 0.003 | 0.08 | 0.04 | 0.02 | 16.2 | 0.028 | 0.011 | Nb/0.06 | 131 | 125 | 24.2 | 36.3 | 36.8 |
| O | 0.025 | 0.20 | 0.61 | 0.019 | 0.003 | 0.06 | 0.07 | 0.02 | 16.3 | 0.020 | 0.030 | V/0.10 | 133 | 129 | 29.0 | 38.5 | 36.2 |
| P | 0.028 | 0.18 | 0.55 | 0.016 | 0.003 | 0.07 | 0.07 | 0.02 | 16.1 | 0.027 | 0.008 | Ti/0.05 V/0.07 | 131 | 126 | 26.1 | 35.8 | 37.0 |
| Q | 0.021 | 0.21 | 0.30 | 0.024 | 0.002 | 0.03 | 0.02 | 0.04 | 13.6 | 0.016 | 0.02 | Nb/0.05 V/0.06 | 127 | 123 | 25.8 | 36.7 | 39.8 |
| R | 0.026 | 0.18 | 0.72 | 0.019 | 0.003 | 0.16 | 0.03 | 0.02 | 17.7 | 0.025 | 0.015 | Ti/0.05 Nb/0.06 | 138 | 138 | 30.7 | 39.9 | 36.5 |
| S | 0.027 | 0.26 | 0.26 | 0.021 | 0.003 | 0.04 | 0.12 | 0.06 | 16.2 | 0.028 | 0.006 | Ti/0.02 Nb/0.05 V/0.05 | 135 | 131 | 29.2 | 38.6 | 37.1 |
| T | 0.020 | 0.17 | 0.32 | 0.016 | 0.003 | 0.04 | 0.30 | 0.21 | 13.4 | 0.007 | 0.002 | Ti/0.14 | 126 | 125 | 26.1 | 36.0 | 40.3 |
| U | 0.024 | 0.14 | 0.61 | 0.022 | 0.001 | 0.03 | 0.06 | 0.05 | 16.1 | 0.011 | 0.002 | Nb/0.18 | 133 | 134 | 29.8 | 39.2 | 36.8 |
| V | 0.011 | 0.08 | 0.09 | 0.013 | 0.002 | 0.40 | 0.02 | 0.43 | 18.3 | 0.005 | 0.003 | V/0.19 | 136 | 136 | 28.1 | 39.0 | 37.5 |
| W | 0.019 | 0.15 | 0.31 | 0.022 | 0.003 | 0.21 | 0.03 | 0.02 | 13.4 | 0.023 | 0.001 | Ti/0.07 Nb/0.08 | 124 | 119 | 25.0 | 35.5 | 41.3 |
| X | 0.006 | 0.16 | 0.86 | 0.021 | 0.002 | 0.04 | 0.03 | 0.02 | 16.2 | 0.021 | 0.002 | Ti/0.04 V/0.10 | 132 | 128 | 28.3 | 37.5 | 38.8 |
| Y | 0.022 | 0.21 | 0.29 | 0.023 | 0.002 | 0.04 | 0.15 | 0.03 | 17.9 | 0.010 | 0.002 | Nb/0.10 V/0.12 | 140 | 135 | 30.7 | 39.9 | 36.8 |
| Z | 0.020 | 0.11 | 0.35 | 0.020 | 0.003 | 0.03 | 0.04 | 0.02 | 18.0 | 0.026 | 0.002 | Ti/0.06 Nb/0.08 V/0.02 | 136 | 132 | 29.5 | 39.1 | 37.2 |
| COMPARATIVE STAINLESS STEEL | | | | | | | | | | | | | | | | | |
| SUS-430 | 0.050 | 0.49 | 0.60 | 0.045 | 0.005 | 0.12 | 0.03 | 0.14 | 16.2 | 0.035 | 0.003 | — | 149 | 157 | 34.2 | 49.0 | 31.1 |
| Italian Lira | 0.040 | 0.35 | 0.39 | 0.018 | 0.008 | 0.099 | 0.02 | 0.005 | 17.4 | 0.025 | 0.002 | — | 138 | 163 | 32.5 | 51.2 | 32.4 |
| 1 | 0.007 | 0.48 | 0.88 | 0.025 | 0.006 | 0.13 | 0.03 | 0.01 | 16.3 | 0.008 | 0.004 | Ti/0.36 | 141 | 155 | 28.3 | 48.7 | 33.2 |
| 2 | 0.008 | 0.51 | 0.85 | 0.030 | 0.006 | 0.12 | 0.05 | 0.08 | 16.3 | 0.007 | 0.03 | Nb/0.50 | 144 | 147 | 29.5 | 50.3 | 32.8 |

Further referring to Table 1, each of Samples A to X and 1 and 2 were melted by using a vacuum high frequency induction furnace and were cast into a 30 kg ingot, both in the same way. Each of these ingots was heated at 1250° C. under the same conditions as each other, then hot-rolled into a hot rolled sheet with a thickness of 3mm, where the hot rolling finishing temperature was 830° C. Each of the hot rolled sheets was annealed in a conventional manner, then cold-rolled and subjected to final annealing. Annealed cold-rolled sheets, each with a thickness of 1.2 mm were obtained.

Metals for coins are generally 1.2 mm to 2.7 mm thick. Neither products of examples of the present invention nor those of the comparative examples showed any surface deterioration which might be caused by ridging. Further, no difficulties were encounted in subsequent tests that might have been caused by ridging. Accordingly, no compensatory measures were needed to be taken in regard to ridging.

The mechanical properties of the products of each example, i.e. Hv hardness, yield strength, tensile strength and elongation of each sample were measured and are shown in Table 1. Table 1 (third line from the bottom) shows data relating to a 100 lira Italian coin. The Italian nation has for many years had commercial experience in production of stainless steel coins. Table 1 shows the hardness measurement based on a test piece which had a recrystallized structure after heat treatment at 750° C. for five minutes. It is clear from Table 1 that the Hv hardness of examples of the present invention are within the range of 103 to 138, and are remarkably softer than the products of the comparative examples of stainless steel for Italian coins. The hardness values of the products produced in the comparative examples are remarkably high. This is thought to be caused by the fact that solid solute N and solid solute Ti and Nb contributed materially to hardness increases.

Referring to the Examples, and particularly to sample specimens B and J, and sample specimens F and L as representative of steel with a chromium content of 12.5% by weight and 17.5% by weight respectively, these were subjected to tests for corrosion resistance, abrasion resistance and coining formability compared with sample specimens of cupronickel, brass, aluminum and nickel, which have been used as a material for coins. The corrosion resistance of each specimen was determined from its pitting corrosion potential in an artificially-made perspiration solution.

An OHGOSHI-type abrasion resistance testing machine was used. A specific abrasion was measured at a loading of 3.2 kg, an abrasion distance of 66.6 m and an abrasion speed of 0.51 m/sec.

The optimum stamping pressure was determined as follows. A blank coin of 25 mm diameter was stamped out using the materials of specimens B, F, J and L. Each stamped coin was subjected to edging by use of an rimming machine, then to coining by using a die whose material was SKD 11 JIS G 4404. The stamping depth was 250 micro meters. Each coin thus obtained was observed especially for occurence of burr attached to the edge of the coin and for engraving of a pattern on the surface of the coin. From this was determined the optimum stamping pressure for the material.

Cupronickel used for the comparative examples was an alloy consisting of 75% Cu-25% Ni, and the brass used was an alloy consisting of 70% Cu-30% Zn.

Table 2 shows the results of tests for corrosion resistance, abrasion resistance and coining formability under the optimum stamping pressure applicable to each sample.

TABLE 2

| TEST PIECES | PIT CORROSION ELECTRIC POTENTIAL (mV vs. SCE) | SPECIFIC ABRASION AMOUNT ($mm^2/kg$) | OPTIMUM STAMPING PRESSURE (tons) |
|---|---|---|---|
| STEEL OF THE PRESENT INVENTION | | | |
| B | −50 | $2.06 \times 10^{-7}$ | 55 |
| F | +190 | $2.56 \times 10^{-7}$ | 60 |
| J | −60 | $2.63 \times 10^{-7}$ | 55 |
| L | +220 | $2.42 \times 10^{-7}$ | 55 |
| SUS430 | +30 | $2.23 \times 10^{-7}$ | 90 |
| COMPARATIVE TEST PIECES | | | |
| Stainless Steel Italian Coin | +100 | $4.16 \times 10^{-7}$ | 85 |
| Cupronickel | −190 | $2.87 \times 10^{-7}$ | 50 |
| Brass | −230 | $3.41 \times 10^{-7}$ | 70 |
| Al | −820 | $10.20 \times 10^{-7}$ | 40 |
| Ni | −350 | $6.14 \times 10^{-7}$ | 80 |

As is clear from Table 2, examples of the present invention B, F, J and L have superior properties as compared to those of the comparative examples.

Concerning corrosion resistance, the steels of this invention are far superior to other non-steel materials for coins, such as cupronickel, brass, aluminum and nickel, and are about the same with respect to SUS 430 and stainless stees in Italian coins.

Concerning abrasion resistance, the steel of the present invention is far superior to comparative non-steel materials for coins and stainless steel for Italian coins, and about the same with respect to SUS 430. Concerning the optimum stamping pressure which is a very important property of the material for stamping formation by cold pressing such as for coins, the steels of this invention showed remarkably lower pressure values even without any annealing after edging.

Even comparing other comparative examples of non-steel materials for coins, the steel of the present invention is superior to brass and nickel, and even has such low stamping pressures as to attain the levels applicable to cupronickel and aluminum. Thus, the steel of the present invention is shown to be a surprisingly advantageous material for subjecting to cold press formation, such as for coins.

The measured softness is peculiar to the steel of this invention as shown in Table 1.

As is clear from Table 1, the stainless steel for the current Italian coins is quite hard, having a Vickers hardness of 163. As is clear from a comparison of FIGS. 1 and 2, the engraving of the surface pattern of the stainless steel Italian coin was shallower and produced a more obscure image than that of the Japanese 100 yen coin made of cupronickel.

Increasing the pressure applied by the stamping press would seem to improve the depth of engraving of the coin, but on the other hand, it seriously shortens the life of the die, which is rather expensive.

In case of aluminum addition, but no significant addition of Ti, Nb or V, an ultrasoft ferritic stainless steel having a Vickers hardness less than about 120 may be obtained according to a preferred embodiment of this invention by limiting the range of chromium content from 11.5% to 14% by weight, (see Table 1, Examples A and B), and has been discovered to be very advantageous for coin production.

An ultrasoft ferritic stainless steel having a Vickers hardness less than about 130 may be obtained in accordance with this invention by limiting the range of chromium from about 14% to about 19% by weight as shown in Table 1, Examples C to H and preferably, by limiting the phosphorus content to a maximum of 0.022% by weight and by limiting the manganese content to a maximum of 0.50 by weight, as indicated by Examples C, D, F, H and I of Table 1.

Although the total content of aluminum is allowed to reach up to 0.2% by weight in this invention, it is preferably from 0.03 to 0.09% by weight from the standpoint of obtaining a sufficient softening effect and sufficient deoxidation, these limits being shown in Examples D, E and F.

In case of Ti, Nb and/or V addition, an ultrasoft ferritic stainless steel having a Vickers hardness less than about 125 may be obtained according to a preferred embodiment of this invention by limiting the range of chromium content from 11.5% to 14% by weight, as shown in Table 1, Examples T and W, and has been discovered to be very advantageous for coin production.

An ultrasoft ferritic stainless steel having a Vickers hardness less than about 135 may be obtained in accordance with this invention by limiting the range of chromium from about 14% to about 19% by weight as shown in Table 1, and preferably, by limiting the phosphorus content to a maximum of 0.22% by weight and by limiting the manganese content to a maximum of 0.61% by weight, as indicated by Examples V and Z of Table 1.

Although the contents of titanium, niobium and vanadium are allowed to reach up to 0.2% by weight in this invention, the total content of these three elements is preferably from 0.015 to 0.16 by weight, these limits being shown in Examples T, W, X and Z.

In case of Al and Ti, Nb and/or V addition, an ultrasoft ferritic stainless steel having a Vickers hardness less than about 125 may be obtained according to a preferred embodiment of this invention by limiting the range of chromium content from 11.5% to 15% by weight, as shown in Table 1, Example J, K and Q, and has been discovered to be very advantageous for coin production.

An ultrasoft ferritic stainless steel having a Vickers hardness less than about 135 may be obtained in accordance with this invention by limiting the range of chromium from about 15% to about 20% by weight as shown in Table 1, and preferably, by limiting the phosphorus content to a maximum of 0.024% by weight and by limiting the manganese content to a maximum of 0.61% by weight, as indicated by Examples L, M, N, O, P and S of Table 1.

Although the total content of aluminum is allowed to reach up to 0.2% by weight in this invention, it is preferably from 0.010% to 0.030% by weight from the standpoint of deoxidation, these limits being shown in Examples L, N, O and R.

In this invention an ultrasoft ferritic stainless steel having especially strong corrosion resistance may be obtained by preferably limiting the range of carbon content from 0.002 to 0.02% by weight, as in Examples A, B, C, E, G, H, I, K, L, M, V, W, X and Z.

It will accordingly be appreciated that the ferritic stainless steel of the present invention has a unique and remarkably advantageous composition. It attains the objects of the present invention by achieving ultrasoftness and high corrosion resistance. According to this invention the effective contents of Si, P, Cu, Mo and N in the steel are reduced in carefully controlled amounts. Concurrently the addition of one or more members of the group consisting of Al, Ti, Nb and V in amounts of 0.005% to 0.2% cause the solid solution hardening effects of N to become harmless. This is achieved by way of stabilization of those elements as AlN, TiN, NbN and VN, respectively.

Accordingly the steel of the present invention has very soft properties and a hardness Hv of about 100 to 140, and accordingly its optimum stamping pressure is very low.

The steel of the present invention has remarkably superior corrosion and abrasion resistance as compared to other non-steel materials conventionally used for coins.

The surface quality of the cold-rolled product of the present invention is excellent.

The cost of production of ultrasoft ferritic stainless steel of this invention is comparatively low. In actual use as a material for coins, the ultrasoft ferritic stainless steel of the present invention is sharply superior with respect to virtually all important characteristics to conventional ferritic stainless steels used for Italian coins.

The following is claimed:

1. An ultrasoft ferritic stainless steel having excellent stamping formability and corrosion resistance in use, which consists essentially of:

about 0.002 to 0.03% by weight of carbon, about 0.01 to 0.30% by weight of silicon, about 0.01 to 1.5% by weight of manganese, about 0.003 to 0.04% by weight of phosphorus, about 0.001 to 0.15% by weight of sulfur, about 0.02 to 1.0% by weight of nickel, about 0.005 to 0.50% by weight of copper, about 0.01 to 0.6% by weight of molybdenum, about 11.5% to 20% by weight of chromium, about 0.005 to 0.03% by weight of nitrogen, about 0.005% to 0.20% by weight of aluminum, and the balance consisting of iron and conventional impurities, said ultrasoft steel having a Vickers hardness equal to about 140 or less.

2. An ultrasoft ferritic stainless steel having excellent stamping formability and corrosion resistance in use, which consists essentially of:

about 0.002 to 0.03% by weight of carbon, about 0.01 to 0.30% by weight of silicon, about 0.01 to 1.5% by weight of manganese, about 0.003 to 0.04% by weight of phosphorus, about 0.001 to 0.15% by weight of sulfur, about 0.02 to 1.0% by weight of nickel, about 0.005 to 0.5% by weight of copper, about 0.01 to 0.6% by weight of molybdenum, about 11.5% to 20% by weight of chromium, about 0.005 to 0.03% by weight of nitrogen, further comprising:

an alloy component consisting essentially of one or more members selected from the group consisting of 0.005% to 0.20% by weight of titanium, 0.005% to 0.20% by weight of niobium and 0.005% to 0.20% by weight of vanadium, and the balance consisting of iron and conventional impurities, said ultrasoft steel having a Vickers hardness equal to about 140 or less.

3. An ultrasoft ferritic stainless steel as defined in claim 1, further comprising:

an alloy component consisting essentially of one or more members selected from the group consisting of 0.005% to 0.20% by weight of titanium, 0.005% to 0.20% by weight of niobium and 0.005% to 0.20% by weight of vanadium.

4. An ultrasoft ferritic stainless steel as defined in claim 1, wherein the content of chromium is from 11.5 to 14% by weight, said ultrasoft stainless steel having a Vickers hardness equal to or less than about 120.

5. An ultrasoft ferritic stainless steel as defined in claim 1, wherein the content of chromium is from 14% to 19% by weight, said ultrasoft stainless steel having a Vickers hardness equal to or less than about 130.

6. An ultrasoft ferritic stainless steel as defined in claim 1, wherein the content of phosphorus is less than 0.022% by weight, the content of manganese being less than about 0.50% by weight.

7. An ultrasoft ferritic stainless steel as defined in claim 1, wherein the total content of aluminum is from 0.03 to 0.09% by weight.

8. An ultrasoft ferritic stainless steel as defined in claim 2, wherein the content of chromium is from 11.5 to 14% by weight, said ultrasoft stainless steel having a Vickers hardness equal to or less than about 125.

9. An ultrasoft ferritic stainless steel as defined in claim 2, wherein the content of chromium is from 14% to 19% by weight, said ultrasoft stainless steel having a Vickers hardness equal to or less than about 135.

10. An ultrasoft ferritic stainless steel as defined in claim 9, wherein the content of phosphorus is less than 0.022% by weight, the content of manganese being less than about 0.61% by weight.

11. An ultrasoft ferritic stainless steel as defined in claim 2, wherein the total content of titanium, niobium and vanadium is from 0.015 to 0.16% by weight.

12. An ultrasoft ferritic stainless steel as defined in claim 3, wherein the content of chromium is from 11.5 to 15% by weight, said ultrasoft stainless steel having a Vickers hardness equal to or less than about 125.

13. An ultrasoft ferritic stainless steel as defined in claim 3, wherein the content of chromium is from 15% to 20% by weight, said ultrasoft stainless steel having a Vickers hardness equal to or less than about 135.

14. An ultrasoft ferritic stainless steel as defined in claim 3, wherein the content of phosphorus is less than 0.024% by weight, the content of manganese being less than about 0.61% by weight.

15. An ultrasoft ferritic stainless steel as defined in claim 13, wherein the total content of aluminum is from 0.010 to 0.030 by weight.

16. An ultrasoft ferritic stainless steel as defined in any one of claims 1 to 3, wherein the content of carbon is substantially from 0.002% to about 0.02% by weight.

* * * * *